US008651260B2

(12) United States Patent
Hasler et al.

(10) Patent No.: US 8,651,260 B2
(45) Date of Patent: Feb. 18, 2014

(54) METHOD AND DEVICE FOR HANDLING DRINK CONTAINERS

(75) Inventors: Uwe Hasler, Regensburg (DE); Josef Mayer, Regensburg (DE); Markus Zoelfl, Metten (DE); Norbert Heimann, Obertraubling (DE); Josef Raith, Pfarrer (DE)

(73) Assignee: Krones AG (DE)

( * ) Notice: Subject to any disclaimer, the term of this patent is extended or adjusted under 35 U.S.C. 154(b) by 395 days.

(21) Appl. No.: 13/058,173

(22) PCT Filed: Aug. 14, 2009

(86) PCT No.: PCT/EP2009/060545

§ 371 (c)(1), (2), (4) Date: Feb. 8, 2011

(87) PCT Pub. No.: WO2010/018224

PCT Pub. Date: Feb. 18, 2010

(65) Prior Publication Data

US 2011/0132720 A1 Jun. 9, 2011

(30) Foreign Application Priority Data

Aug. 14, 2008 (DE) ..... 10 2008 037 708

(51) Int. Cl.
*B65B 57/00* (2006.01)
*B67C 3/00* (2006.01)

(52) U.S. Cl.
USPC ..... 198/341.06; 53/397; 53/410

(58) Field of Classification Search
USPC ..... 198/341.01, 341.03, 341.06; 53/64, 53/397, 410, 415, 444, 581, 582
See application file for complete search history.

(56) References Cited

U.S. PATENT DOCUMENTS 4,397,709 A 8/1983 Schwenzer ..... 156/351
4,562,773 A * 1/1986 Diggle ..... 101/27
4,629,528 A * 12/1986 Tanaka et al. ..... 156/351

(Continued)

FOREIGN PATENT DOCUMENTS

DE 3332117 12/1984 ..... B65C 9/00
DE 19642987 4/1998 ..... B65B 55/04

(Continued)

OTHER PUBLICATIONS

Chinese Office Action issued in related application No. 200980132467.9, dated Feb. 24, 2012 (9 pgs).

(Continued)

*Primary Examiner* — Douglas Hess
(74) *Attorney, Agent, or Firm* — Hayes Soloway P.C.

(57) ABSTRACT

A method and a device for handling containers is described, wherein the containers are transported along a predetermined transport path and combined with at least one other product, the amount of which can be determined, in such a way that the product is fed to each individual container in a predetermined feed area of the transport path, wherein the other product is routed along a feed path to the feed area. At least one characterizing state is determined in a detection area disposed upstream relative to the feed area in a direction of transport of the containers, the state being characteristic of a number of containers fed, and a residual amount for the product that remains to be fed to the predetermined feed area until the product is switched is determined as a function of this characteristic state.

21 Claims, 1 Drawing Sheet

(56) References Cited

U.S. PATENT DOCUMENTS

| | | | | | |
|---|---|---|---|---|---|
| 4,962,840 | A * | 10/1990 | Miura et al. | 198/347.1 |
| RE33,579 | E * | 4/1991 | Voltmer et al. | 156/552 |
| 5,056,294 | A * | 10/1991 | Focke | 53/201 |
| 5,980,087 | A * | 11/1999 | Brandon et al. | 700/125 |
| 6,095,218 | A * | 8/2000 | Delmolino et al. | 156/353 |
| 6,428,639 | B1 * | 8/2002 | Oldenburg et al. | 156/64 |
| 6,641,684 | B2 * | 11/2003 | Instance | 156/64 |
| 6,751,934 | B2 * | 6/2004 | Focke et al. | 53/444 |
| 7,147,028 | B2 * | 12/2006 | Denholm et al. | 156/569 |
| 7,380,386 | B2 * | 6/2008 | Spatafora | 53/64 |
| 7,584,589 | B2 * | 9/2009 | Stafford et al. | 53/154 |
| 7,591,120 | B2 * | 9/2009 | Hafker et al. | 53/64 |
| 7,684,889 | B2 * | 3/2010 | Focke et al. | 700/116 |

FOREIGN PATENT DOCUMENTS

| | | | |
|---|---|---|---|
| DE | 69900390 | 6/2002 | A61L 2/20 |
| DE | 69910631 | 2/2004 | H04N 1/58 |
| DE | 10236241 | 3/2004 | B65B 55/04 |
| DE | 102008030156 | 12/2009 | B29C 49/42 |
| EP | 1041006 | 10/2000 | B65B 19/28 |
| EP | 1122168 | 8/2001 | B65B 3/02 |
| EP | 1225129 | 7/2002 | B65B 19/28 |
| EP | 2094312 | 9/2009 | A61L 2/04 |
| JP | 2003290226 | 10/2003 | A61B 5/022 |
| WO | 0242055 | 5/2002 | B29C 49/00 |
| WO | 2006136498 | 12/2006 | B65B 55/10 |

OTHER PUBLICATIONS

Chinese Office Action (w/English translation) issued in corresponding application No. 200980132467.9, dated Oct. 24, 2012 (13 pgs).

European Office Action, dated Oct. 19, 2011 (4 pgs).

International Search Report issued in Applicants' underlying PCT Application Serial No. PCT/EP2009/060545 dated Feb. 18, 2010, 2 pgs.

* cited by examiner

METHOD AND DEVICE FOR HANDLING DRINK CONTAINERS

FIELD OF THE INVENTION

The present invention relates to a method and an apparatus for handling containers, in particular containers for beverages.

BACKGROUND OF THE INVENTION

It is known from the prior art that in the framework of a production and filling process for containers these containers are handled in widely differing ways and further elements are attached to these bottles, such as for example labels or closures, or a beverage is also poured into them. In this case it is frequently customary that at the beginning of a process it is established how many containers will be produced and in the framework of the method the attempt is made to use the correct amounts of material for this. The material is supplied to the machines in filling and packaging lines in such a way that all the products to be processed are conveyed from a magazine to the location of the processing by way of a conveying unit which has a specified reservoir. This applies in particular for all countable piece goods, such as for example pre-forms, closures, labels, printed shrink films, containers, cardboard blanks, intermediate layers or empty pallets. In this case it is also known that the supply of individual pieces takes place from a magazine without gaps, it being possible for this magazine to be understood as being an individual machine. This applies for example to pre-forms, closures, cold-glue labels, cardboard blanks, intermediate layers or empty pallets.

In addition, it is also known for the supply of materials—which are introduced in bulk onto a conveying unit, such as for example a roll—to be carried out without gaps even if the conveying unit in question has to be changed. This applies for example in the case of plastics-material wrap-around labels, sleeve labels, shrink films and Henkel foils. In this case it is further known to change packaging means of this type optionally when changing the conveying unit by automatic adhesion during continuous operation of the machine. It is usual for the processing procedure to be carried out with a reduced capacity.

The supply with the actual product, i.e. the charged product, such as for example a beverage, is carried out through a tank which can likewise be understood as being a magazine. In this way all the materials are stored in one magazine and are conveyed by way of a suitable conveying unit, which has a specific holding capacity, to the location of the processing. In the case of the liquid, pipelines for example may be involved.

In this case the problem arises that losses in production time arise in the event of a change of product or even a change of rolls. In order to carry out supply activities of this type on the machine as far as possible without a loss in production time, consideration has been given to enlarging the magazines in question in such a way that the number of such procedures is minimized. In addition, it is known for magazines of different or the same type to be set up centrally at a location in order to centralize incoming work activities.

To this end it is nevertheless necessary that the conveying units to be used should contain large quantities or piece numbers of the goods in question. In addition, it is also known, in the case of individual applications with automatic changing, to store mass conveying units such as rolls in magazines in such a way that the equipping procedures of mass conveying units are additionally reduced in terms of time. On the other hand, however, magazines or conveying units of such size are difficult, in particular in the event of a change in the production programme in the line, since large magazines or reservoirs in conveying units have to be emptied at the end of the processing procedure. On the one hand this procedure requires a relatively large amount of time and on the other hand the packaging materials and charged products in question can possibly no longer be used and have thus to be regarded as scrap.

DE 102 36 241 A1 discloses a filling apparatus for capsules, in particular medicinal capsules.

DE 33 32 117 T1 discloses a labelling apparatus for the application of labels to articles, in which the labels are cut from an endless strip and a continuous supply to the labelling station should be possible without interruption of a carrier tape or carrier strip carrying an uninterrupted sequence of adhesive labels.

SUMMARY OF THE INVENTION

The object of the present invention is therefore to reduce the stoppage times, in particular in the case of a change in the production programme in a line. In addition, the object of the invention is to reduce the amount of scrap which is caused by a change in the production programme.

In the case of a method according to the invention of handling containers, the containers are conveyed along a preset conveying line and are brought together with at least one further product capable of being determined with respect to its quantity, in such a way that the product is supplied to each individual container in a pre-determined supply area of the conveying line, the product being conveyed to the supply area along a supply line. According to the invention at least one characteristic state, which is characteristic of a number of the containers supplied, is determined in a detection area which is situated upstream with respect to the supply area in a conveying direction of the containers, and a residual quantity of the product to be supplied, which has still to be supplied until a change of product into the pre-determined supply area, is determined in a manner dependent upon this characteristic state.

In particular, it is therefore proposed to link information on the quantity of the containers in a specified portion with information on the quantity of the product to be supplied in a further portion.

The characteristic state can be for example a number of containers which are still to be treated before a change of product or which are to be brought together with the product. In addition, it would be possible for the state to be a filling state of a conveying device. In this wa for example, it could be established at the start of a conveying line that no further containers are arriving and so only the containers present in the conveying path are to be handled. In this case the characteristic state is based upon a differentiation as to whether a container is present at a specified point in the plant or not.

In addition, it would also be possible for a characteristic state to be determined which is characteristic of a quantity of the product and a number of containers are determined in a manner dependent upon this characteristic state. These two methods substantially correspond to each other and they are based on different standpoints with respect to the quantities or numbers observed or determined. In addition, the aforesaid characteristic state can also be pre-set by the user or an automatic device. In this way for example a container barrier can be closed and in this way it is possible to prevent further containers from arriving in the conveying line. In the case of units grouped in a block or of units in which the containers are conveyed piece-wise, the aforesaid characteristic state is known from the start and can be read out—for example from a memory device.

The following description is given with reference to containers which are provided with labels. However, this is to be understood only by way of example. It is pointed out that the invention is also capable of being applied to containers which for example are provided with closures or which are also filled with a product or to containers which are palletized and the like. In this case the further product can be both a solid product, such as the labels, closures or intermediate layers mentioned, or a liquid product, such as in particular a beverage to be poured in or some other liquid. In addition, it would be possible to use the method according to the invention and the apparatus for the provision of containers with a plurality of products, i.e. both for the provision with the closures and for the provision with labels.

In this way, the invention is based upon the idea of conveying the materials and products in question just in the correct quantity or with only slight deviations into the respective machines until the end of the production programme at the location of the processing.

It is preferable for the residual quantity to be determined whilst taking into consideration a partial quantity of the product present in the supply line. In this case for example it is possible to determine the quantity of labels or closures which are present between a magazine for the product and the transfer area. In addition, the amount of a liquid product in a supply line between a tank and the filling area can also be determined.

In addition, it is preferable for the residual quantity to be determined whilst taking into consideration a piece number of the containers between the detection area and the supply area, i.e. the conveying line in this area. In this way it is possible for example for an accumulation line, in which a substantially specified number of containers are arranged, to be arranged between the detection area and the supply area.

Whilst taking into consideration this quantity as well, it is possible for example to establish how many labels still have to be prepared so that for example the supply line for the product can also be run substantially empty.

In this way, it is possible on the one hand for the times for product changes to be minimized, since an old label band need not be removed from the supply area. In addition, the loss of label material can be reduced in this way.

As a result, the method according to the invention makes it possible to avoid emptying times of the conveying units and also to avoid possible losses of materials which can no longer be used.

In the case of mass conveying units, such as for example rolls for packaging materials, the automatic exchange of conveying units is carried out so soon that at the end of the procedure in the machine the type of material for processing which is required next is made available, i.e. for example a following line production programme. In this way, emptying times can also be avoided, and, in addition, loading times for the new mass conveying unit can also be avoided as well as a loss of material inside the conveying unit between the magazine and the location of the processing in the machine. It is preferable for the specified quantity to be a residual quantity of the product. In this way, it is determined, in a manner dependent upon the characteristic number, what quantity of the product is still required in order to equip a specified margin properly.

In this case it is preferable for a product counter to be present at individual locations and, in a particularly preferred manner, at each location of the value creation at which material is applied to or introduced into the semi-finished product inside a machine. In this way it is possible to determine how many semi-finished products are produced from the start of production on the individual machines. The information as to how many products are to be processed at the respective machines or stations is fed into the machine or the station manually or through an electronic data-processing system. In this way the quantity of semi-finished products still to be processed is known at any time.

In addition, it would also be possible for estimated values to be taken as a basis for a number, such as for example the number of containers, in certain portions of a plant. In this case it can possibly be accepted that these estimated values do not correspond precisely to the actual values, since the changing times are reduced even in the case of slightly different values. It is preferable for a certain safety reserve also to be retained with respect to the product.

Furthermore, it would also be possible for numbers of containers to be determined, for example optically, in the conveying lines and for the number determined in this way to be taken into consideration in the control of the plant. In addition, it is possible for various locations of the plant to be provided with counting mechanisms which in each case count the number of the passing containers there. In addition, counting mechanisms could also be provided at any possible diversion apparatus which for example separate out defective containers, in order to be able to correct accordingly a number which has been detected.

As mentioned above, in a manner dependent upon the production programme it is also additionally known how many material objects or products are present between the actual magazine and the location of the processing in the machine, and preferably also how many products are still present in the actual magazine itself. In this case it is also possible for estimated values to be taken as a basis for the quantity of products between the magazine and the location of the processing.

In the case of a preferred method the product is selected from a number of products which includes container closures, labels, foils, cardboard blanks, intermediate layers, pallets, liquids, in particular beverages, combinations thereof and the like.

In the case of a further preferred method the product is stored in a storage device, i.e. in particular in the above-mentioned magazine.

It is preferable for the aforesaid quantity to be determined whilst taking into consideration a reference quantity for the containers which are brought together or which are to be brought together with the product. In this case this reference quantity can be maximum piece number pre-set by the user for items to be produced.

A synchronization in terms of quantity between the quantity of semi-finished products still to be processed and the quantity of materials from the location of the magazine to the location of the processing, i.e. the supply area, then ensures a minimal use of material on the one hand and brief change-over times on the other. In this case, synchronization can be provided by the balancing of the quantities and a time schedule resulting therefrom. Following this time schedule it is possible for material change-over procedures to be initiated.

In addition, it would also be possible for the containers to be provided with different products, for example with labels and with closures in order to apply the method according to the invention to both products, i.e. both to labels and to the closures, and optionally also to a product to be poured in.

It is preferable for different products, for example labels of a different type, to be stored in the storage device, at least temporarily. In this case it is preferable for these different products to be stored at different points in time or for different periods of time, at least temporarily. It is preferable for the quantity mentioned above to be determined in order to prepare for a change in the product, i.e. the method according to the invention is used in particular to prepare for a change in the product, for example a change from one label to another label.

It is advantageous for the containers to be selected from a group of containers which includes plastic bottles, glass bottles, pre-forms, tubes, cartons, beverage crates pallet carriers and the like. This means that according to the definition the containers need not necessarily be closed in a liquid-tight manner. In the case of beverage crates it would be possible for example for beverage crates provided with containers to be brought together to form pallets in each case, it being possible for the products for example to be intermediate layers or carriers for such pallets in this case.

In this case it is possible for the individual processing units of a handling machine in question to be grouped together in a block, i.e. a conveying device for example which conveys the containers in a conveying line is grouped in a block with a supply device which supplies the product. It would also be possible, however, for a grouping in a block in this way not to be present, in which case it is preferable for an accumulation detection to be provided, which detects an accumulation of the containers and also takes this into consideration during the determination of the quantity.

The present invention further relates to an apparatus for handling containers, which has a conveying device which conveys the containers along a pre-set conveying line, as well as a supply unit which supplies a further product to each individual container in a pre-set supply area, a supply line being provided along which, starting from a storage device for the product, the product is supplied to the supply unit. In this case the apparatus has a detection unit which is arranged upstream with respect to the supply unit in a conveying direction of the containers and which detects a characteristic state which is characteristic of a number of the containers which are supplied or which are to be supplied. In addition, the apparatus has a control device which, in a manner dependent upon this characteristic state, determines a residual quantity for the product to be supplied which is still to be supplied to the pre-determined supply area until the product is changed.

It is preferable for the supply unit to be selected from a group of supply units which includes labelling devices for containers, closure devices for containers, assembly units for groups of containers or the like.

It is preferable for the apparatus for handling containers to be a plant which provides the containers with labels. The actual labelling device in this case is the supply unit mentioned above. It would also be possible, however, for the apparatus to be a plant which expands pre-forms to form containers and then fills them with a product such as a beverage.

BRIEF DESCRIPTION OF THE DRAWINGS

Further advantages and embodiments may be seen in the accompanying drawings. In the drawings

DETAILED DESCRIPTION OF THE INVENTION

Figure 1:
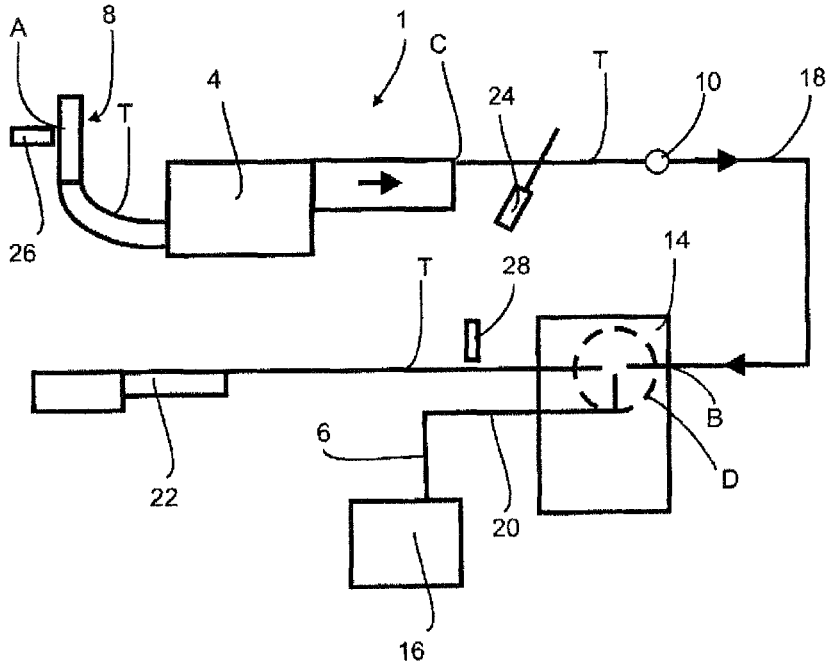
FIG. 1 is a block diagram of an apparatus according to the invention.

FIG. 1 is an illustration in the manner of a block diagram of an apparatus 1 according to the invention for handling containers 10. The apparatus 1 shown in FIG. 1 is a plant which provides filled bottles with labels. This illustration is to be understood, however, as being by way of example and is also capable of being applied to other apparatus which handle or equip containers in a pre-set manner, such as for example closing means, filling plants, disinfection devices and the like.

The reference sign T relates to a conveying path along which the containers already filled in this case are conveyed. In an accumulation area 4 a plurality of rows of containers 10 are conveyed adjacent to one another. The arrows indicated in FIG. 1 show the conveying direction. In the case of the embodiment shown in FIG. 1 the containers 10 are moved from a multiplicity of paths or wider paths to fewer paths or narrower paths. It is also possible, however, for the individual paths to be arranged in a different way.

The reference number 18 designates a supply portion for the containers, which extends between a point A which is situated in a detection area 8, and a point B which in this case marks the end of the supply portion 18. It is preferable for the number of containers 10 which are present in this supply portion 18 in working operation to be known or capable of being determined. In this case, however, it may be sufficient if only the approximate number of containers in the supply portion 18 is known.

The reference number 14 designates a supply unit, in which case this supply unit 14 is a labelling device which supplies labels to the containers 10 or applies these labels, starting from a strip of labels 20 (illustrated only diagrammatically), to the containers 10. In this case the labels are supplied, starting from a magazine 16, by way of a supply line 6 to the supply unit 14. The labels are thus the product described in the introduction. The reference sign D designates the supply area in which the product is supplied to the containers 10. In this case this supply area is situated in the region of the supply unit 14.

It is also preferable for at least one value to be known which is characteristic of the number of labels which are present in the supply line 6 during the working operation This value can be the absolute number of labels, but it would also be possible for a length of the strip of labels between the magazine 16 and the supply unit 14 to be known. In this case too it is not absolutely necessary for the exact length or the exact number of labels to be known, but an approximate number may be sufficient.

Figure 2:
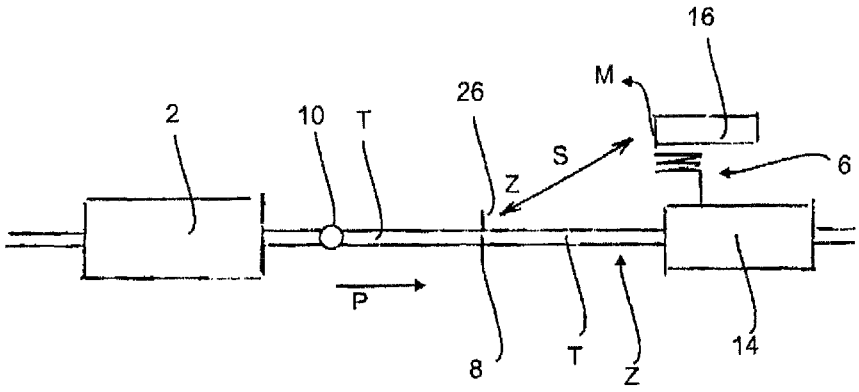
FIG. 2 is a further illustration in the manner of a block diagram of an apparatus according to the invention.

FIG. 2 is an illustration to explain the control mechanisms. The arrow P designates the conveying direction of the containers 10. The reference number 26 designates the detection unit which detects the state Z characteristic of a number of the containers 10 and passes it on to the magazine by means of a signal S. This can be an accumulation detection device, which also detects whether containers are present in the area 8. A quantity M for the product to be supplied, in this case the number of the labels still to be supplied, is determined in a manner dependent upon this state Z.

If for example containers 10 are no longer present in this detection area 8 on account of an imminent change of the product, then this information can be passed on to the storage unit or the magazine 16. On account of the number (detected or still to be detected) of containers which are present between points A and B and on account of the number—likewise known—of labels in the supply line 6, the magazine or a storage device inside this magazine can decide when the supply of labels 20 should be interrupted.

In this way for example the user can be given the instruction to cut the strip of labels at a specific location. It is then preferable for that area of the labels which is still present in the supply line 6 to be applied to the containers 10. In this way, this portion of labels is not lost on the one hand and in the event of a change of the product this portion also need not be removed from the supply line, which is occasionally extremely complicated, on the other hand.

In this way, in a sequence by way of example, a filling device 2 can also report to the labelling device 14 or the magazine 16 an impending change of the product and/or a signal which indicates that the filling device is empty or on the other hand, as mentioned, the detection unit 26 can detect a lack of containers. The magazine can now begin the empty running of its label store. As soon as a specified minimum has been reached, the labelling machine 14 preferably reduces speed in order to lower the risk of a crack in the strip in the event of a breakdown.

It would also be possible, however, for a further detection unit 24 (FIG. 1) to detect a lack of containers, i.e. an absence of the containers. This further detection unit is arranged in a region of the conveying path in which the containers rest one against the other in single file, so that the number of containers between points C and B is known in a manner dependent upon the type. In the case of conveying them piecewise, the number of the containers is known in any case.

In addition, it would also be possible, in particular when the method is carried out with another product, for an end portion of a roll with the type of label which has just run out or which will no longer be used to be joined to a starter portion of a roll with a new type of label, so that the production can be continued in a seamless manner from one type of product to a further type of product. This affords the advantage that the new strip of labels also need not be threaded into the supply line in a complicated manner, but can be drawn in with the preceding strip in a virtually automatic manner. This procedure can also be applied to those products which are supplied to the process piecewise, such as pallets. In this case, however, the old roll need not be used up completely and the new roll can be already started.

In addition, a barrier can close on account of the lack of containers and the supply unit 14 can terminate the labelling procedure. In this case it is preferable for some remaining labels to be left behind in order to compensate possible failures, in particular of other machine parts. After that, the change-over to a new product can take place on the supply unit 14 and finally the production with the new product can be started.

After the application of the labels 20 to the containers 10, the containers 10 are conveyed further along the conveying path T (FIG. 1). In this case it is possible for packing or assembly units to be provided which group the containers. In addition, assembly units of this type can be integrated into the plant in the manner according to the invention. In this way, it is possible for example to report in a similar manner to an assembly unit of this type that a flow of (possibly already labelled) containers 10 is interrupted and so only those containers which are in a portion 22 are to be provided with a specified packaging material or are to be brought together in a specific manner.

To this end a further detection unit 28 can be provided. The control, however, can also be carried out with the aid of the detection unit 24 and/or the detection unit 26 In the case of more complex plants it is possible for a plurality of detection units to be provided which control a process as a whole, and in this way make a saving of the equipment used in each case for the containers at a multiplicity of locations.

All the features disclosed in the application documents are claimed as being essential to the invention, insofar as they are novel either individually or in combination as compared with the prior art.

LIST OF REFERENCES

1 apparatus for handling containers 10
2 filling device
4 accumulation area
6 supply line
8 detection area
10 container
14 supply unit (labelling machine)
16 magazine
18 supply portion
20 strip of labels
24, 28 further detection unit
26 detection unit
T conveying path
A, B, C locations on the supply portion
D supply area
Z characteristic state
S signal
M quantity
P conveying direction of the containers 10

The invention claimed is:

1. A method of handling containers for beverages, wherein the containers are conveyed along a pre-set conveying line and are brought together with a liquid product and at least one other product capable of being determined with respect to its quantity, in such a way that the liquid product and the at least one other product are supplied to each individual container in a pre-determined supply area of the conveying line, wherein the other product is conveyed to a supply area along a supply line, wherein at least one characteristic state, which is characteristic of a number of the containers supplied, is determined in a detection area which is situated upstream with respect to the supply area in a conveying direction of the containers, wherein a residual quantity of the liquid product or other product to be supplied, which has still to be supplied until a change of product into the pre-determined supply area, is determined in a manner dependent upon said at least one characteristic state, and the at least one other product is selected from the group consisting of a container closure, a label, a foil, a cardboard blank, an intermediate layer, and a pallet.

2. The method according to claim 1, wherein the residual quantity is determined whilst taking into consideration a partial quantity of the liquid product or other product present in the supply line.

3. The method according to claim 1, wherein the residual amount is determined whilst taking into consideration a piece number of the containers between the detection area and the supply area.

4. The method according to claim 1, wherein the liquid product or other product is stored in a storage device.

5. The method according to claim 4, wherein different products are stored in the storage device, at least temporarily.

6. The method according to claim 1, wherein the residual quantity of product is determined whilst taking into consideration a reference quantity for the containers which are brought together with the product.

7. The method according to claim 1, wherein the containers are selected from a group consisting of a plastic bottle, a glass bottle, a pre-form, a tube, a carton, a beverage crate.

8. The method according to claim 1, wherein other product is processed directly following the residual quantity.

9. The method according to claim 1, wherein the liquid product comprises a beverage.

10. The method according to claim 1, wherein the residual quantity is determined whilst taking into account of a reference amount of the containers which have been brought together with the liquid product or the other product.

11. The method according to claim 10, wherein the reference amount is a predefinable maximal number of pieces of goods to be produced.

12. The method according to claim 1, wherein the residual quantity is determined in order to allow for a synchronisation in the terms of quantity.

13. The method according to claim 12, wherein the liquid product comprises a beverage.

14. The method according to claim 1, wherein a product counter is present at individual locations.

15. The method according to claim 14, wherein product counters are present at each location at which a product is applied to or introduced into containers.

16. The method according to claim 1, wherein the containers are moved from a multiplicity of paths or wider paths to fewer paths or narrower paths.

17. An apparatus for handling containers for beverages, which comprises a conveying device for conveying the containers along a pre-set conveying line, a supply unit for supplying a liquid product and at least one other product to each individual container in a pre-set supply area, with a supply line along which, starting from a storage device for the liquid product and the other product, the liquid product and the other product are supplied to the supply unit, wherein the apparatus has a detection unit arranged upstream with respect to the supply unit in a conveying direction of the containers and which detects a characteristic state which is characteristic of a number of the containers which are supplied, wherein the apparatus has a control device which, in a manner dependent upon said characteristic state, determines a residual quantity for the liquid product and the other product to be supplied which is still to be supplied to the pre-determined supply area until the product is changed, wherein the at least one other product is selected from the group consisting of at least one of a container closure, a label, a foil, a cardboard blank, an intermediate layer, and a pallet.

18. The apparatus according to claim 12, wherein the supply unit is selected from the group consisting of a labelling device, a closure device, and an assembly units.

19. The apparatus according to claim 12, wherein the liquid product comprises a beverage.

20. A method of handling containers for beverages, wherein the containers are conveyed along a pre-set conveying line and are brought together with a liquid product and at least one other product capable of being determined with respect to its quantity, in such a way that the liquid product and the other product are supplied to each individual container in a pre-determined supply area of the conveying line, wherein the other product is conveyed to the supply area long a supply line, wherein at least one characteristic state, which is characteristic of a number of the containers supplied, is determined in a detection area which is situated upstream with respect to the supply area in a conveying direction of the containers, and wherein a residual quantity of the liquid product or the other product to be supplied, which has still to be supplied until a change of product into the predetermined supply area, is determined in a manner dependent upon said characteristic states, wherein the at least one other product is selected from at least one of the group consisting of a container closure, a label, a foil, a cardboard blank, an intermediate layer, and a pallet, wherein different products are stored in a storage device, at least temporarily.

21. An apparatus according to claim 20, wherein the residual quantity is a predefinable maximal number of pieces of goods to be produced.

* * * * *

UNITED STATES PATENT AND TRADEMARK OFFICE

CERTIFICATE OF CORRECTION

PATENT NO. : 8,651,260 B2
APPLICATION NO. : 13/058173
DATED : February 18, 2014
INVENTOR(S) : Hasler et al.

It is certified that error appears in the above-identified patent and that said Letters Patent is hereby corrected as shown below:

In the Claims

Claim 18, Col. 10, line 8 "according to claim 12, wherein" should be --according to claim 17, wherein--

Claim 19, Col. 10, line 11 "according to claim 12, wherein" should be --according to claim 17, wherein--

Signed and Sealed this
Thirtieth Day of September, 2014

Michelle K. Lee

Michelle K. Lee
*Deputy Director of the United States Patent and Trademark Office*